US007090545B2

(12) United States Patent
Morikawa

(10) Patent No.: US 7,090,545 B2
(45) Date of Patent: Aug. 15, 2006

(54) TERMINAL FITTING

(75) Inventor: Takashi Morikawa, Yokkaichi (JP)

(73) Assignee: Sumitomo Wiring Systems, Ltd., (JP)

( * ) Notice: Subject to any disclaimer, the term of this patent is extended or adjusted under 35 U.S.C. 154(b) by 0 days.

(21) Appl. No.: 11/031,025

(22) Filed: Jan. 7, 2005

(65) Prior Publication Data

US 2006/0003641 A1 Jan. 5, 2006

(30) Foreign Application Priority Data

Jan. 7, 2004 (JP) ..... 2004-002306

(51) Int. Cl.
*H01R 13/187* (2006.01)

(52) U.S. Cl. ..... 439/852; 439/843; 439/845; 439/397; 439/399; 439/851

(58) Field of Classification Search ..... 439/867, 439/852, 851, 845, 843
See application file for complete search history.

(56) References Cited

U.S. PATENT DOCUMENTS 5,593,328 A * 1/1997 Okada et al. ..... 439/851
5,921,821 A * 7/1999 Oka et al. ..... 439/845
6,386,916 B1 * 5/2002 Tachi et al. ..... 439/595
6,468,116 B1 * 10/2002 Koide ..... 439/867
6,478,636 B1 * 11/2002 Makita et al. ..... 439/852
6,520,811 B1 * 2/2003 Mitani et al. ..... 439/852
6,527,601 B1 * 3/2003 Chen ..... 439/852
6,547,608 B1 * 4/2003 Sato et al. ..... 439/852
6,565,396 B1 * 5/2003 Saka et al. ..... 439/843

FOREIGN PATENT DOCUMENTS

JP 63-3527 1/1988

* cited by examiner

*Primary Examiner*—Tulsidas C. Patel
*Assistant Examiner*—Harshad C Patel
(74) *Attorney, Agent, or Firm*—Gerald E. Hespos; Anthony J. Casella

(57) ABSTRACT

A terminal fitting (A) has a receiving portion (17) with a contact surface (18) for contacting a male tab (T). The contact surface (18) is widest at the front end and substantially narrowed toward the back. A rate at which a contact area of the male tab (T) and the contact surface (18) increases in the insertion process of the male tab (T) is smaller as compared to a substantially rectangular contact surface having a constant width. The terminal fitting (A) provides good operation feeling upon manually connecting the male tab (T) with the terminal fitting (A).

13 Claims, 6 Drawing Sheets

TERMINAL FITTING

BACKGROUND OF THE INVENTION

1. Field of the Invention

The invention relates to a terminal fitting.

2. Description of the Related Art

Japanese Unexamined Utility Model Publication No. S63-35274 discloses a female terminal fitting with opposite front and rear ends. A rectangular tube is formed at the front end and is configured to receive a male tab inserted from the front. A resilient contact is arranged inside the rectangular tube, and a receiving portion is embossed on a wall of the rectangular tube to project toward the resilient contact. The receiving portion is parallel with an inserting direction of the male tab. The male tab inserted into the rectangular tube is squeezed resiliently between the receiving portion and the resilient contact, and is held in surface contact with the receiving portion.

The above-described prior art terminal fitting is illustrated in FIG. 6(A) and is identified by the letter B. The terminal fitting B has a substantially rectangular receiving portion Ba for receiving a male tab T, and the width of the receiving portion Ba is constant along the inserting direction of the male tab T. Insertion resistance is created between the terminal fitting B and the male tab T due to friction resulting from a resilient force of the resilient contact piece (not shown) as the male tab T is inserted into the terminal fitting B. However, the terminal fitting B has the substantially rectangular receiving portion Ba. Thus, the value of the insertion resistance varies widely, and a maximum value of the insertion resistance is larger as an insertion stroke of the male tab T increases. Accordingly, there has been a problem of poor operation feeling upon manually connecting the male tab T with the terminal fitting B.

The invention was developed in view of the above problem and an object thereof is to improve operation feeling upon connecting a male tab.

SUMMARY OF THE INVENTION

The invention relates to a terminal fitting with a tube configured for receiving a male tab inserted from the front. A resilient contact is arranged in the tube, and a receiving portion extends substantially parallel with an inserting direction of the male tab. The male tab inserted into the tube is squeezed resiliently between the receiving portion and the resilient contact piece to achieve substantially surface contact with the receiving portion. A contact surface of the receiving portion with the male tab is shaped so that the width normal to the inserting direction is largest at the front end and is narrowed toward the back.

The contact area between the male tab and the contact surface of the receiving portion necessarily increases during the tab insertion process. However, the rate of increase is smaller for the above-described contact surface, as compared to a substantially rectangular contact surface having a constant width. Experiments demonstrate the value of the insertion resistance for a terminal fitting with the above-described contact surface did not increase to a large extent as the insertion stroke of the male tab increased and a maximum value of the insertion resistance was relatively small. Thus, the terminal fitting of the present invention provides good operation feeling upon manually connecting the male tab with the terminal fitting.

The receiving portion preferably is a substantially flat plate formed by embossing a part of a wall of the tube to project towards the resilient contact.

Opposite lateral edges of the receiving portion preferably are substantially straight.

Since the width of the contact surface decreases at a constant rate along the inserting direction of the male tab, the insertion resistance is stable.

The contact surface preferably is substantially transversely symmetrical. Thus, the male tab will not incline either to the left or right even if the opposite lateral edges of the male tab are laterally more outward than the contact surface.

The maximum width of the contact surface preferably is less than the width of the male tab. Additionally, the opposite lateral edges of the male tab are laterally more outward than the contact surface. If the male tab is narrower than the contact surface, the receiving portion could undergo a curving deformation to recess a contact portion thereof with the male tab. However, in the present invention, the lateral edges of the male tab are laterally more outward than the contact surface. Therefore, there is no possibility that the receiving portion will undergo a curving deformation and the contact surface and the male tab can be held in surface contact.

The width of the contact surface decreases constantly at a substantially constant rate towards the back. Thus, the contact surface substantially has a shape of a triangle or trapezoid, and preferably of a transversely symmetrical isosceles triangle or trapezoid.

The male tab preferably has a thickness normal to the inserting direction that is smaller than a space between the resilient contact piece and the contact surface in an unbiased state.

At least part of an area of the receiving portion along the peripheral edge of the contact surface preferably comprises a slanted portion preferably substantially continuously surrounding over the substantially entire circumference of the contact surface.

These and other features of the invention will become more apparent upon reading the following detailed description of preferred embodiments and accompanying drawings.

DETAILED DESCRIPTION OF THE PREFERRED EMBODIMENTS

Figure 1:
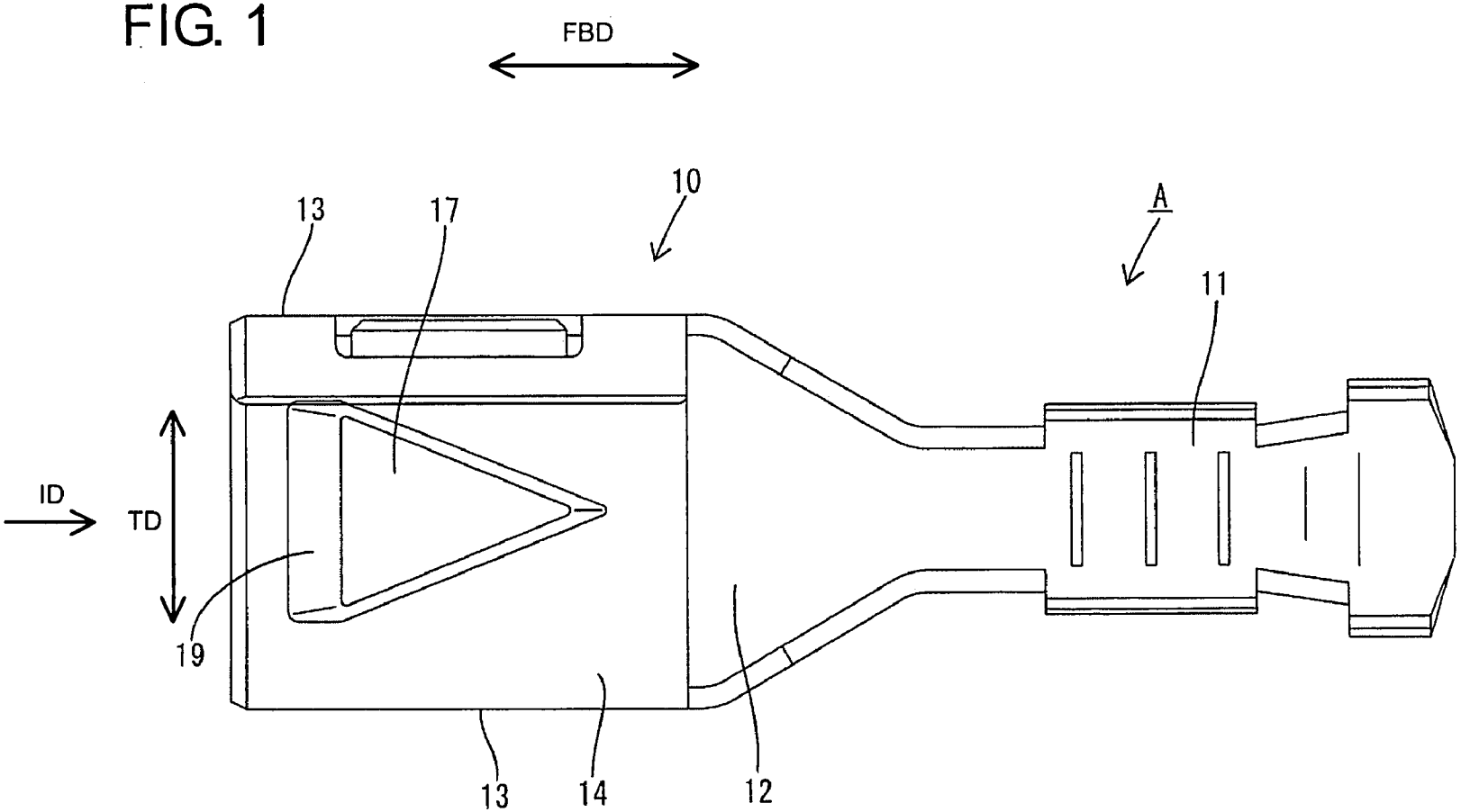
FIG. 1 is a plan view of a terminal fitting according to one embodiment of the invention.
Figure 2:
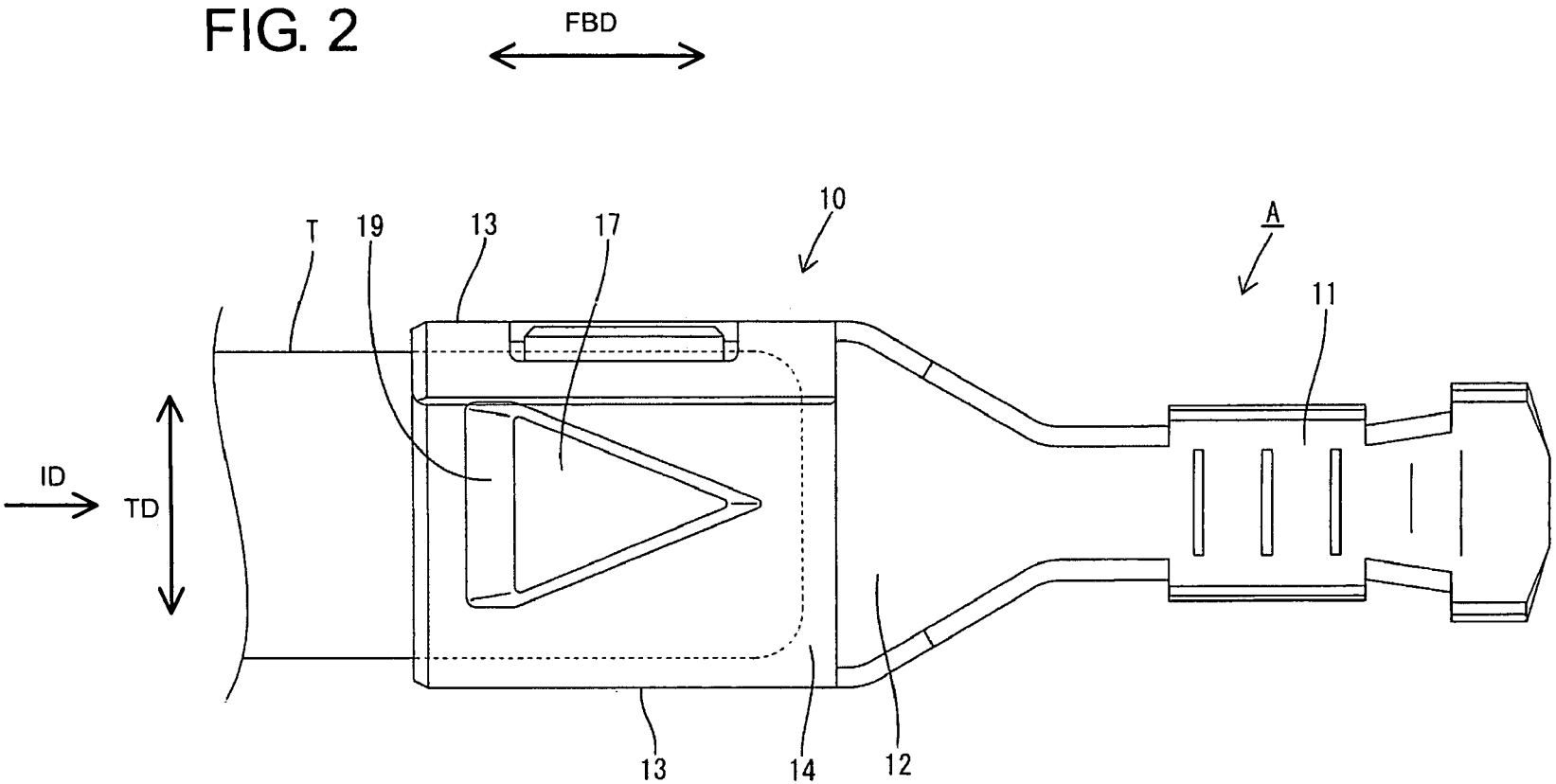
FIG. 2 is a plan view of the terminal fitting showing a state where a tab is inserted therein.
Figure 3:
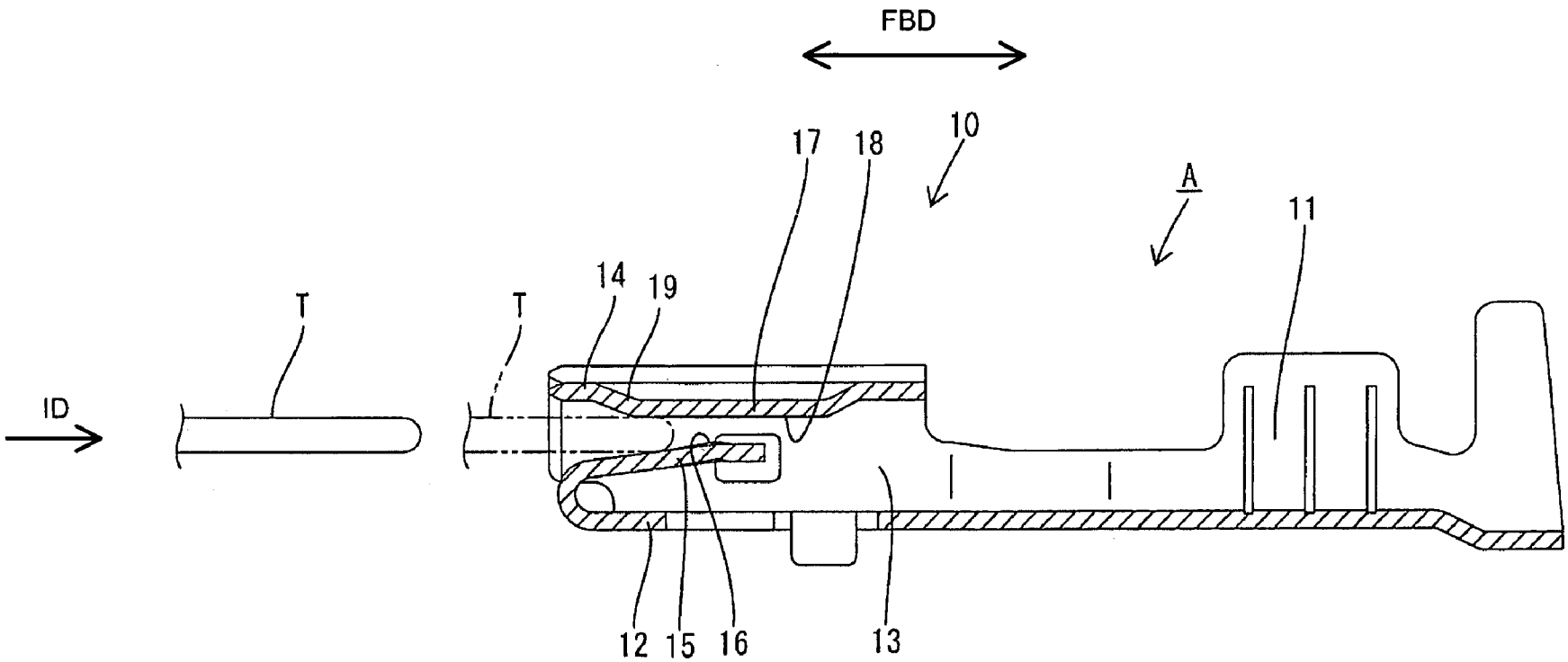
FIG. 3 is a section of the terminal fitting.
Figure 4:
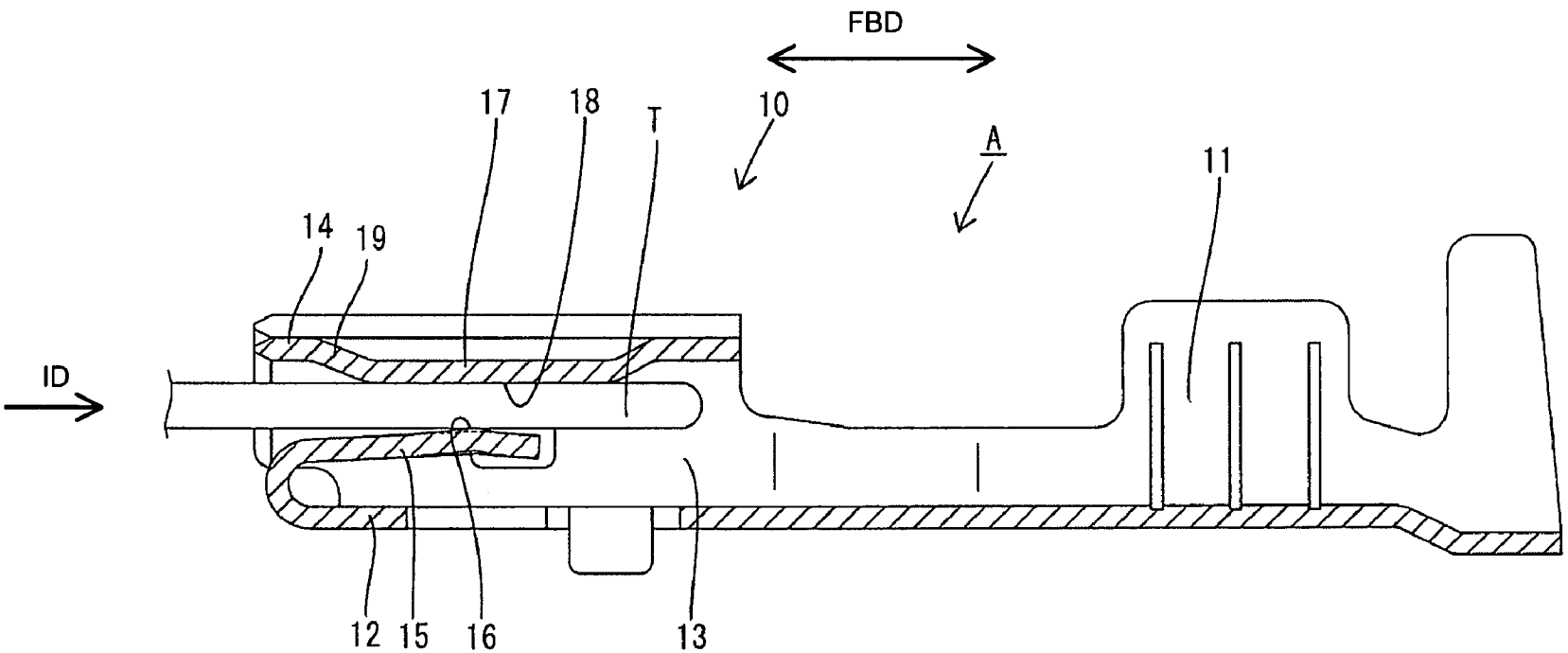
FIG. 4 is a section of the terminal fitting showing the tab inserted therein.

The letter A in FIGS. 1 TO 5 identifies a female terminal fitting in accordance with the subject invention. The terminal fitting A is long and narrow in forward and backward directions FBD. A substantially rectangular tube 10 is formed at a front side of the terminal fitting A, and a wire connecting portion 11 is formed at a rear side. The wire connecting portion 11 is an open barrel that can be crimped, bent or folded into connection with a wire (not shown). The rectangular tube 10 has a bottom plate 12 that is continuous and narrow along forward and backward directions FBD over substantially the entire length of the terminal fitting A. Side plates 13 stand up from the opposite lateral edges of the bottom plate 12, and a substantially horizontal upper plate 14 extends from the upper edge of one side plate 13 towards the opposite side plate 13. The upper plate 14 is substantially parallel with the bottom plate 12. The terms upper and lower are used herein to provide a convenient frame of reference. However, these terms are not intended to imply a required gravitational orientation.

A resilient contact beam 15 is folded from the front end of the bottom plate 12 so that the contact beam 15 slopes up and back into the rectangular tube 10. A contact portion 16 is defined at the rear end of resilient contact beam 15 for contacting a male tab T. The contact portion 16 is the portion of the contact beam 15 farthest from the bottom plate 12.

A receiving portion 17 is embossed in the upper plate 14 and projects down towards the resilient contact beam 15. The receiving portion 17 is a substantially flat plate aligned substantially parallel with the upper plate 14, but stepped down from the upper plate 14. The receiving portion 17 has a planar contact surface 18 that faces the resilient contact beam 15 for contacting the upper surface of the male tab T. The width of the contact surface 18 along the transverse direction TD is largest at the front and decreases at a substantially constant rate towards the back. Thus, the contact surface is a transversely symmetrical isosceles triangle or trapezoid. Accordingly, opposite lateral edges of the receiving portion 17 and the contact surface 18 are straight lines that are oblique to an inserting direction ID of the male tab T into the rectangular tube 10. Additionally, the receiving portion 17 and the contact surface 18 have wedge-like shapes pointed towards the back and in the inserting direction ID. A slanted portion 19 extends around the periphery of the contact surface 18. Widthwise centers of the receiving portion 17, the contact surface 18, the rectangular tube 10 and the male tab T inserted in the rectangular tube 10 substantially coincide with each other. Furthermore, the largest width of the contact surface 18 is smaller than the width of the male tab T.

The male tab T is narrow and long in forward and backward directions FBD and can be inserted in the inserting direction ID into the rectangular tube 10 from the front and substantially parallel with the contact surface 18. The male tab T has a thickness measured normal to the inserting direction ID that is constant over substantially the entire length. The thickness of the male tab T is less than vertical spacing between the contact 16 and the contact surface 18 in an unbiased undeformed state of the resilient contact beam 15. The width of the male tab T is substantially constant over the entire length of the male tab T, and is larger than the largest width of the contact surface 18 but smaller than the spacing between the inner side surfaces of the rectangular tube 10.

The male tab T is inserted along the inserting direction ID into the rectangular tube 10. As a result, the leading end of the male tab T contacts the resilient contact beam 15 at a position before the contact 16 and the upper surface of the leading end of the male tab T contacts the contact surface 18. The male tab T is squeezed vertically between the resilient contact beam 15 and the receiving portion 17 as the insertion progresses. As a result, the resilient contact beam 15 deforms down. The resilient contact beam 15 exerts resilient restoring forces on the male tab T. These restoring forces create friction between the male tab T and the resilient contact beam 15 and between the male tab T and the contact surface 18. This friction generates an insertion resistance between the male tab T and the terminal fitting A.

Figure 5:
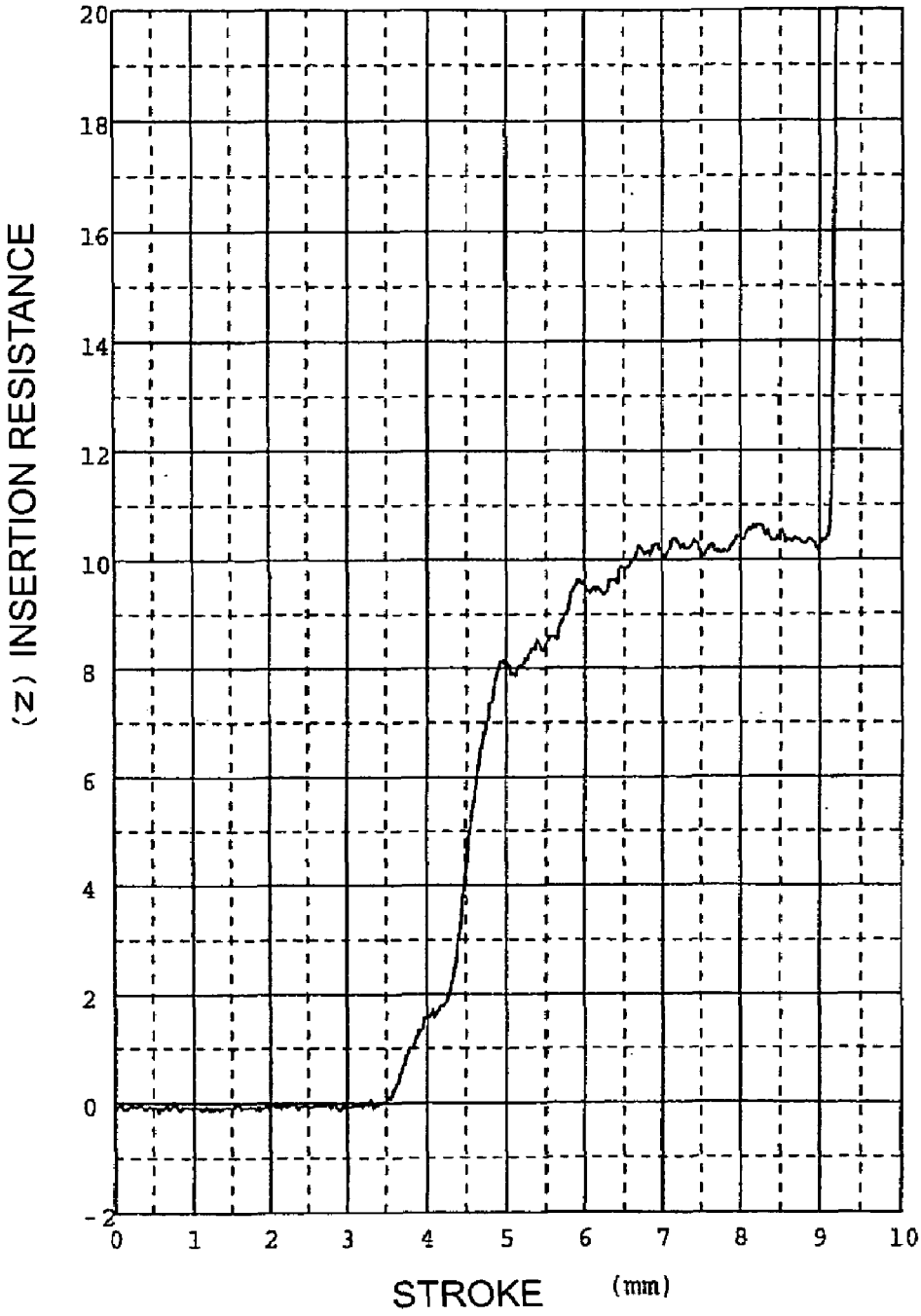
FIG. 5 is a graph showing insertion resistance.

FIG. 5 shows a relationship between the insertion resistance and the insertion stroke or distance of the male tab T into the rectangular tube 10. This graph represents data obtained by experiments. According to this graph, the insertion resistance suddenly increases while the insertion stroke changes from about 3.5 mm to about 5.0 mm. Thereafter, the insertion resistance increases only slightly (about 2 N) while the insertion stroke increases from about 5.0 mm to about 6.5 mm and hardly changes while the insertion stroke increases from about 6.5 mm to about 9.0 mm where the insertion is substantially completed. A rate at which a contact area of the male tab T and the contact surface 18 of the receiving portion 17 increases in the insertion process of the male tab T is smaller as compared to the prior art terminal fitting B whose contact surface Ba is substantially a rectangle of constant width.

Figure 6A:
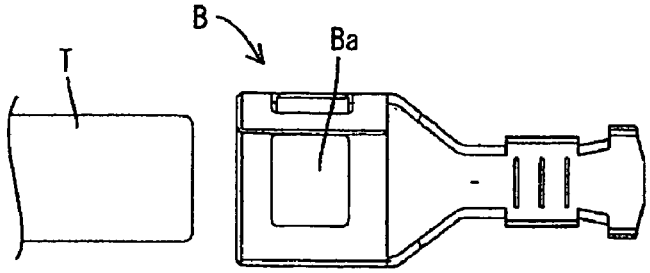
FIG. 6(A) PRIOR ART
FIG. 6(A) is a plan view of a prior art terminal fitting and FIG. 6(B) is a graph showing the insertion resistance of a tab in the terminal fitting of FIG. 6(A).
Figure 6B:
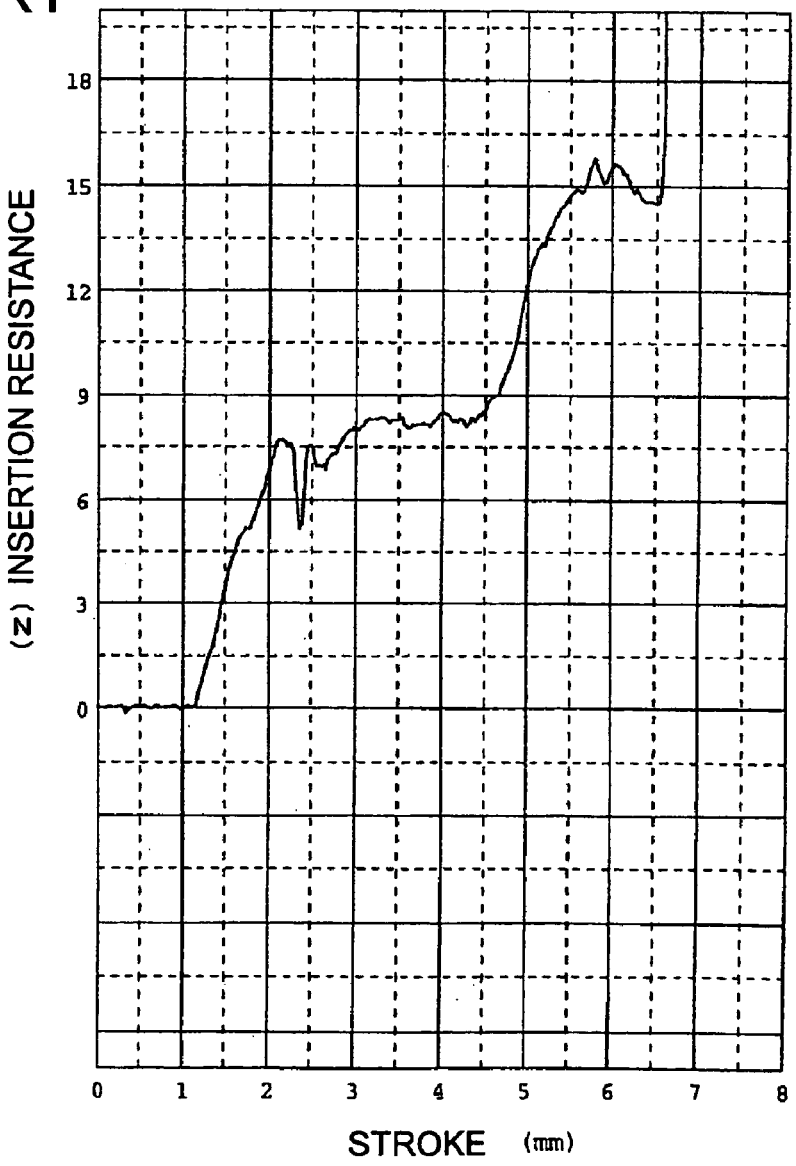
FIG. 6(B) PRIOR ART

FIG. 6(B) shows the insertion resistance of the prior art terminal fitting B of FIG. 6(A). In this regard, the prior art terminal fitting B has a substantially rectangular planar receiving portion Ba. Other conditions, such as the thickness of the male tab T and the spacing between the contact surface and the resilient contact piece in the unbiased state are the same as for the terminal fitting A. With reference to FIG. 6(B), insertion resistance suddenly increases at an initial stage of the insertion (by about 8N), but then becomes substantially stable. However, the insertion resistance increases again upon entering the rear half of the insertion process. A maximum value of insertion resistance immediately before the completion of the insertion is a value (about 15 N) exceeding the maximum insertion resistance of the terminal fitting A shown in FIG. 5 by about 10 N.

The prior art terminal fitting B has a larger variation of the insertion resistance and a larger maximum insertion resistance than the terminal fitting A. Thus, the operation feeling upon inserting the male tab T into the terminal fitting B is not good. Contrary to this, the terminal fitting A has a smaller variation of the insertion resistance and a smaller maximum insertion resistance value than the prior art terminal fitting B. Thus, the operation feeling upon inserting the male tab T into the terminal fitting A is better.

The opposite lateral edges of the receiving portion 17 are straight and the width of the contact surface 18 decreases at the constant rate along the insertion direction ID of the male tab T. Thus, the insertion resistance is stable.

The receiving portion 17 could undergo a curving deformation and could recess a contact portion with the male tab T if the male tab T was narrower than the contact surface 18. However, the maximum width of the contact surface 18 is less than the width of the male tab T and the lateral edges of the male tab T are laterally more outward than the contact surface 18. Therefore, the receiving portion 17 will not undergo a curving deformation and the contact surface 18 and the male tab T will achieve surface contact.

The contact surface 18 is transversely symmetrical along the width or transverse direction TD. Thus, the male tab T will not incline laterally even if the lateral edges of the male tab T are laterally more outward than the contact surface 18.

The invention is not limited to the above described and illustrated embodiment. For example, the following embodiments are also embraced by the technical scope of the present invention as defined by the claims. Beside the following embodiments, various changes can be made without departing from the scope and spirit of the present invention as defined by the claims.

The width of the contact surface of the receiving portion constantly decreases towards the back (in the inserting direction) in the foregoing embodiment. However, it may decrease towards the back as a whole although repeatedly increasing and decreasing slightly toward the back.

Although the width of the contact surface of the receiving portion decreases at the substantially constant rate toward the back in the foregoing embodiment, it may decrease at various rates.

Although the contact is transversely symmetric along width direction in the foregoing embodiment, it may be transversely asymmetric.

The largest width of the contact surface is smaller than the width of the male tab in the foregoing embodiment. However, the contact surface may be wider than the male tab according to the invention.

Lateral edges of the receiving portion are straight in the foregoing embodiment, but they may curve in or out according to the present invention.

Lateral edges of the receiving portion 17 are oblique to the inserting direction ID of the male tab T in the foregoing embodiment. However, at least one side edge may be parallel with the inserting direction of the male tab.

Although the rear end of the receiving portion is wedge-shaped in the foregoing embodiment, it may be trapezoidal or arcuate instead of pointed.

What is claimed is:

1. A terminal fitting, comprising:

a tube having a front end for receiving a male tab;

a resilient contact beam arranged in the tube, and a receiving portion extending substantially parallel to an inserting direction of the male tab, wherein:

the male tab inserted into the tube is squeezed resiliently between the receiving portion and the resilient contact beam to achieve substantially surface contact with the receiving portion, and a contact surface of the receiving portion with the male tab is shaped such that a width thereof is largest at the front end and is narrowed at a substantially constant rate towards the back so that contact surface substantially has a shape of a transversely symmetrical isosceles triangle or trapezoid.

2. The terminal fitting of claim 1, wherein the receiving portion is in a substantially flat plate embossed in a wall of the tube and projecting substantially towards the resilient contact beam.

3. The terminal fitting of claim 1, wherein opposite lateral edges of the receiving portion are substantially straight.

4. The terminal fitting of claim 1, wherein the contact surface is transversely symmetrical.

5. The terminal fitting of claim 1, wherein the contact surface has a maximum width that is narrower than a width of the male tab, and opposite lateral edges of the male tab are located laterally more outward than the contact surface.

6. The terminal fitting of claim 1, wherein a thickness of the male tab substantially normal to the inserting direction is smaller than spacing between the resilient contact beam and the contact surface in an unbiased state where the resilient contact beam is not resiliently deformed.

7. The terminal fitting of claim 1, wherein the receiving portion has a slanted portion extending around the contact surface.

8. A terminal fitting comprising a substantially rectangular tube having a front end, a rear end and an insertion direction extending between the ends, a resilient contact beam arranged in the tube and being deflectable in a deflection direction extending substantially transverse to the insertion direction, and a receiving portion opposed to the resilient contact beam having a contact surface extending substantially parallel to the inserting direction, the contact surface having a width transverse to both the insertion direction and the deformation direction that is largest adjacent the front end and narrowed substantially continuously towards the rear end.

9. The terminal fitting of claim 8, wherein the tube has opposed bottom and top walls and opposed side walls extending between the bottom and top walls, the resilient contact beam extending from the bottom wall and being between the side walls, the receiving portion being embossed in the top wall.

10. The terminal fitting of claim 9, wherein opposite lateral edges of the receiving portion are substantially straight.

11. The terminal fitting of claim 10, wherein the contact surface is transversely symmetrical.

12. The terminal fitting of claim 11, wherein the contact surface has a shape of a transversely symmetrical isosceles triangle or trapezoid.

13. The terminal fitting of claim 12, wherein the receiving portion has a slanted portion extending around the contact surface.

* * * * *